US005205053A

United States Patent [19]

Brunner

[11] Patent Number: 5,205,053

[45] Date of Patent: Apr. 27, 1993

[54] APPARATUS FOR CLEANING AND DEMOISTURIZING RUNNING WEBS OF PHOTOGRAPHIC PAPER AND THE LIKE

[75] Inventor: Jürgen Brunner, Munich, Fed. Rep. of Germany

[73] Assignee: AGFA-Gevaert Aktiengesellschaft, Leverkusen, Fed. Rep. of Germany

[21] Appl. No.: 738,465

[22] Filed: Jul. 31, 1991

[30] Foreign Application Priority Data

Aug. 23, 1990 [DE] Fed. Rep. of Germany ..... 4026616

[51] Int. Cl.[5] ..... B26B 13/08

[52] U.S. Cl. ..... 34/155; 34/160

[58] Field of Search ..... 34/155, 156, 160

[56] References Cited

U.S. PATENT DOCUMENTS

| | | | |
|---|---|---|---|
| 378,266 | 2/1888 | Simonds | 34/155 |
| 1,759,804 | 5/1930 | Pieron | 34/160 |
| 3,041,740 | 7/1962 | Allen | 34/160 |
| 3,739,491 | 6/1973 | Creapo et al. | 34/156 |
| 3,925,905 | 12/1975 | Zeiffer | 34/160 X |
| 4,064,637 | 12/1977 | Lindgren | 34/155 X |
| 4,369,584 | 1/1983 | Daane | 34/160 X |
| 4,773,580 | 9/1988 | Schweiger | 226/92 |
| 4,787,547 | 11/1988 | Hella et al. | 34/156 X |

FOREIGN PATENT DOCUMENTS

| | | |
|---|---|---|
| 2056571 | 5/1971 | Fed. Rep. of Germany . |
| 2150796 | 4/1972 | Fed. Rep. of Germany . |

*Primary Examiner*—Stephen M. Hepperle
*Attorney, Agent, or Firm*—Peter K. Kontler

[57] ABSTRACT

A running web of wet exposed and developed photographic paper which issues from a rinsing bath in a developing machine is caused to advance around a fixedly mounted guide roll and through a passage between the guide roll and the orifice of a combined cleaning and drying member which discharges compressed air against successive increments of the running web. The air discharging member is biased upwardly toward the roll to abut flanges which are provided at the ends of the roll and serve to determine the minimum width of the passage in such a way that the air discharging member cannot rise into physical contact with the web.

17 Claims, 2 Drawing Sheets

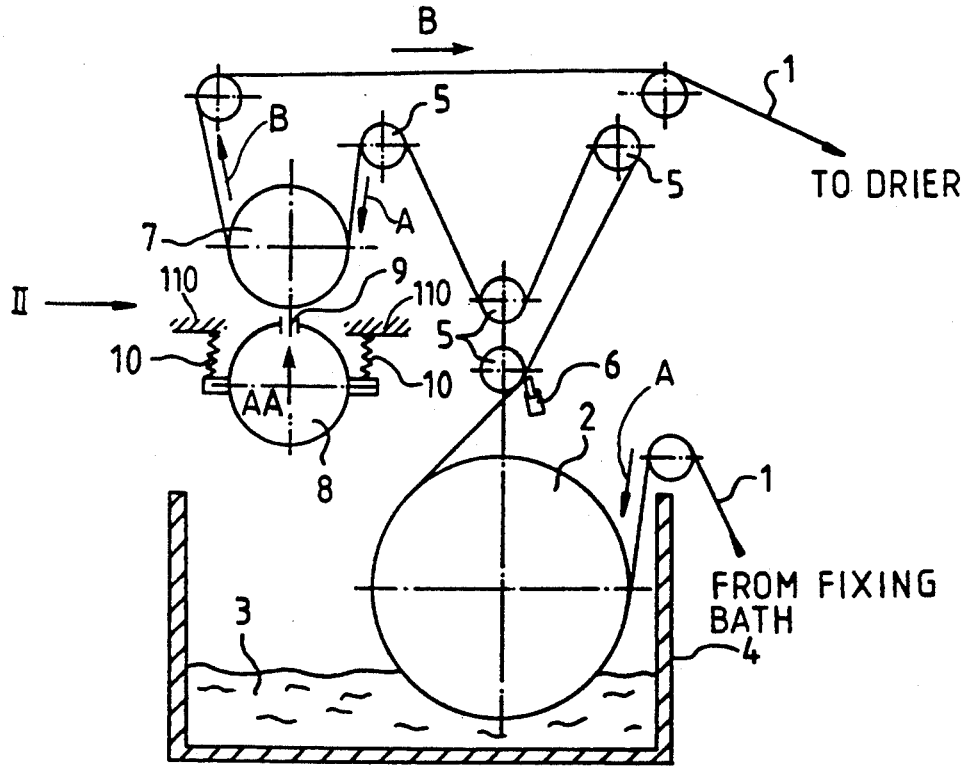
B
1
TO DRIER
5
B
5
A
7
9
110
110
II
5
10
10
6
A
AA
2
8
1
FROM FIXING
BATH
3
4

SOURCE OF COMPRESSED GAS
A
B
III
III
1
7
8
10
11
12
13
14
15
16
17
18
19
20
110
116

APPARATUS FOR CLEANING AND DEMOISTURIZING RUNNING WEBS OF PHOTOGRAPHIC PAPER AND THE LIKE

BACKGROUND OF THE INVENTION

The invention relates to improvements in apparatus for treating running webs of paper, plastic material or the like. More particularly, the invention relates to improvements in apparatus which can be utilized to remove substances which are entrained by running webs by resorting to a gaseous fluid, particularly to remove films and/or droplets of moisture from freshly exposed and developed webs of photographic paper.

Published German patent application No. 20 56 571 discloses a demoisturizing apparatus wherein the moisture-carrying web is trained over a guide roll and advances past a nozzle which discharges a stream of compressed air.

Published German patent application No. 21 50 796 discloses an apparatus wherein a flattened portion of the moisture-carrying web is caused to advance past an air discharging nozzle. The orifice of the nozzle is located in a plate which is adjacent and parallel to the flattened portion of the running web. In order to enhance and optimize the demoisturizing action of air which issues from the nozzle, the width of the gap between the path of the flattened portion of the web and the plate for the orifice of the nozzle must be reduced to a minimum. If the web consists of exposed and freshly developed photographic paper, the pressure of air which is discharged by the orifice in the plate cannot exceed a certain maximum permissible value because any further rise of air pressure could entail damage to images on the exposed and developed web of photographic paper. On the other hand, if the width of the gap is increased above the minimum acceptable value while the pressure of air is maintained at a maximum permissible value, the velocity of air which reaches the adjacent surface of the running web is too low so that air merely shifts but does not disperse the liquid film on the running web. Atomization of the liquid film, and hence actual drying of photographic paper, takes place only when the width of the gap is maintained at an optimum value. Such width is less than is necessary to permit passage of spliced (overlapping) portions of successive webs of photographic paper and/or to permit passage of customary clamps which are used to separably couple the leaders of webs of photographic paper to entraining bands. Reference may be had to commonly owned U.S. Pat. No. 4,773,580 to Schweiger.

OBJECTS OF THE INVENTION

An object of the invention is to provide an apparatus which ensures the establishment of an optimum distance between the nozzle and the running web.

Another object of the invention is to provide an apparatus wherein the optimum width of the passage for the running web is established and maintained in a fully automatic way.

A further object of the invention is to provide an apparatus which can be installed in existing developing machines for webs of photosensitive material.

An additional object of the invention is to provide the apparatus with novel and improved means for determining the minimum width of the passage for advancement of the running web past the locus of impingement of a gaseous fluid.

Still another object of the invention is to provide an apparatus which permits the advancement of splices and/or clamps without affecting the accuracy and predictability of the cleaning and demoisturizing action.

A further object of the invention is to provide the apparatus with novel and improved means for varying the width of the passage for the running web.

Another object of the invention is to provide an apparatus which can be utilized with particular advantage for removal of impurities and/or moisture from running webs of freshly developed photographic paper.

SUMMARY OF THE INVENTION

The invention is embodied in an apparatus for removing entrained substances from running webs with a gaseous fluid, particularly for removing moisture from running webs of exposed and developed photographic paper. The improved apparatus comprises a web guiding member, a fluid discharging member adjacent the web guiding member and defining therewith a web-receiving passage of variable width, and means for supporting at least one of the members for movement relative to the other member in directions to vary the width of the passage.

The web guiding member can include an idler roll or a driven roll, and the web is preferably trained over the roll along an arc of not less than 90°, most preferably close to 180°. The passage is adjacent that portion of the web which is trained over the roll. The arrangement is preferably such that the roll is rotatable about a fixed axis and the fluid discharging member is movable relative to the roll. The apparatus further comprises means for conveying the web toward and away from the roll along a predetermined path having a first portion wherein successive increments of the web advance toward the roll in a first direction and a second portion wherein successive increments of the web advance away from the roll in a second direction (e.g., exactly counter to the first direction). The fluid discharging member is preferably movable relative to the roll in at least one of the first and second directions.

The web guiding member is preferably located at a level above the fluid discharging member, i.e., the roll is located above the passage for the web. The supporting means can include one or more springs and/or other suitable means for biasing the fluid discharging member upwardly toward the roll with a force which compensates for the weight of the fluid discharging member. The force which is applied by the biasing means can slightly exceed the weight of the fluid discharging member, i.e., the fluid discharging member then tends to rise toward the roll to thus reduce the width of the passage. Therefore, the apparatus preferably further comprises means for limiting the extent of movability of the fluid discharging member toward the roll so as to prevent physical contact between the web in the passage and the fluid discharging member. The limiting means can be provided on the roll and can include a flange at one axial end or a flange at each axial end of the roll.

A handle or other suitable means can be provided to move the fluid discharging member to a lower end position in which the width of the passage is sufficient to permit convenient threading of the web through the passage.

The fluid discharging member can include a lower portion (e.g., a stationary lower portion which is connected to a source of compressed air or another suitable gaseous fluid) and an upper portion which is movable relative to the lower portion toward and away from the web guiding member to thereby vary the width of the passage. The upper portion has at least one orifice (e.g., a single orifice in the form of an elongated slot which confronts and extends longitudinally of the passage) which directs fluid against the web in the passage.

The configuration of the passage is preferably such that its width decreases in the direction of advancement of successive increments of the running web into the passage toward the orifice in the upper portion of the fluid discharging member.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a schematic elevational view of a portion of a developing machine for webs of exposed photographic paper wherein the web which issues from the rinsing bath of the developing machine is cleaned and demoisturized in an apparatus embodying one form of the invention;

DESCRIPTION OF PREFERRED EMBODIMENTS

Figures 2, 3:
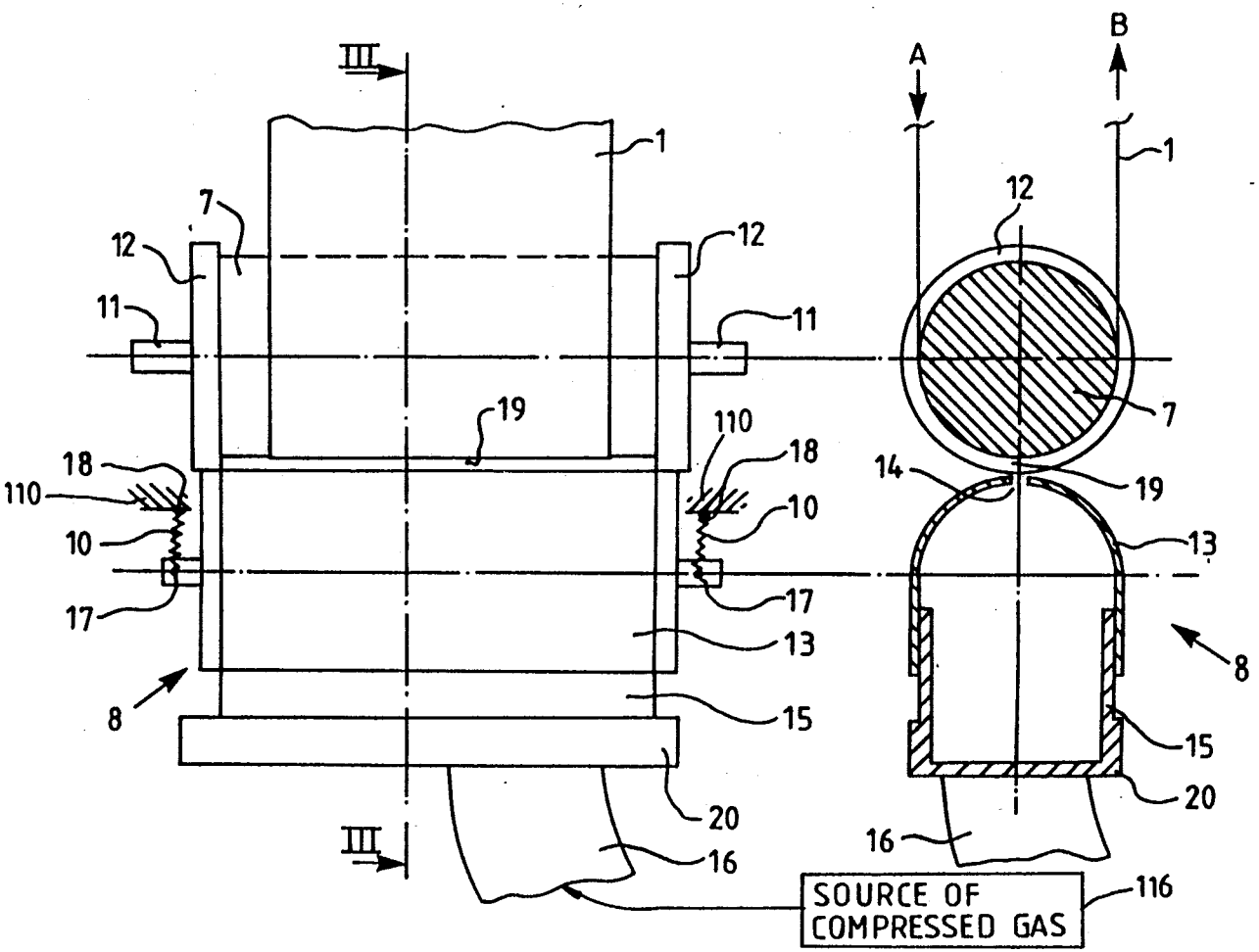
FIG. 2 is an enlarged view as seen in the direction of arrow II in FIG. 1 but showing a modified apparatus.
FIG. 3 is a sectional view substantially as seen in the direction of arrows from the line III—III in FIG. 2.

Referring first to FIG. 1, there is shown a portion of a developing machine for webs 1 of exposed and freshly developed photographic paper. Successive increments of the web 1 are conveyed from a fixing bath (not shown) into a rinsing bath 3 in a vessel 4. The means for conveying the web 1 along a predetermined path includes a large roll 2 in the vessel 4 and a plurality of smaller rolls or pulleys 5. The rinsed web 1 is relieved of moisture in an apparatus which embodies one form of the present invention, and the demoisturized web is then caused to pass through a drier on its way to a cutting or severing station to be subdivided into discrete photographic prints in a manner not forming part of the present invention.

The improved web cleaning and demoisturizing apparatus comprises a web guiding member 7 in the form of an idler roll which is rotatable about a fixed axis, and a fluid discharging member 8 which is installed at a level below the roll 7 and at least a portion of which is movable up and down so as to move its gas-discharging orifice 9 nearer to or further away from that portion of the running web 1 which is trained over the lowermost portion of the peripheral surface of the roll 7. A certain percentage of moisture is removed from the running web 1 during advancement from the bath 3 toward the roll 7 over several pulleys 5 of the conveying means. A fixedly mounted standard air discharging nozzle 6 can be placed next to one of the pulleys 5 between the bath 3 and the roll 7 to remove certain impurities and/or a certain percentage of moisture ahead of the improved apparatus. The developing machine can comprise two or more nozzles 6, e.g., one for each pulley 5 upstream of the roll 7.

The pulleys 5 cooperate with the roll 7 in such a way that the web 1 is trained over the roll 7 along an arc well in excess of 90°, preferably close to or exactly 180°. The nozzle 9 of the gas discharging member 8 is oriented to discharge (arrow AA) a single stream or a row of streams of compressed gas (normally air) in parallelism with the axis of the roll 7 and in the general direction (arrow A) of advancement of successive increments of the running web 1 toward as well as in the general direction (arrow B) of advancement of successive increments of the web 1 away from the six o'clock position of the roll 7.

In accordance with a feature of the invention, at least a portion of at least one of the members 7, 8 is movable toward and away from the other member to thereby vary the width of the web-receiving passage 19 (see FIGS. 2 and 3) in the region of the nozzle 9. As mentioned above, the roll 7 of the apparatus of FIG. 1 is rotatable about a fixed (preferably horizontal) axis. The member 8 is supported and is movable upwardly by several springs 10 each of which is suspended from a stationary carrier 110 and is dimensioned and stressed to bias the member 8 upwardly with a force which at least matches the weight of the member 8, preferably with a force which slightly exceeds the weight of the member 8 so that the latter tends to move upwardly to an upper end position in which the width of the passage 19 is reduced to a minimum. The means for limiting the extent of movability of the member 8 toward the roll 7 includes two flanges 12 (see FIG. 2) which are installed at the axial ends of the roll 7 and ensure that the minimum width of the passage 19 suffices to prevent bodily contact between the running web 1 and the member 8.

A presently preferred embodiment of the improved apparatus is shown in FIGS. 2 and 3. The running web 1 is trained over the lower half of the roll 7 along an arc of exactly or very close to 180° (i.e., the direction (arrow A) of advancement of successive increments of the web toward the passage 19 is parallel to the direction (arrow B) of advancement of successive increments of the web away from the passage 19). The gas discharging member 8 has a stationary lower portion 15 which is connected with a source 116 of compressed gas by a flexible or rigid conduit 16, and an upper portion 13 which sealingly engages the lower portion 15 and is movable up and down under the bias of or against the opposition of two coil springs 10 as well as under the pressure of compressed gas in the member 8. The upper portion 13 of the member 8 has two stubs 17 which are connected to the lowermost convolutions of the respective springs 10, and these springs are suspended (at 18) from the fixed carrier 110. The upper portion 13 of the member 8 has an orifice 14 in the form of an elongated slot which extends in parallelism with the axis (of the shaft 11) of the roll 7 and discharges compressed gas against the underside of the web 1 at the six o'clock position of the roll 7. The width of the passage 19 decreases gradually in the direction of arrow A toward the orifice 14 to thereupon gradually increase in the direction of arrow B.

The bias of the springs 10 suffices to compensate for the weight of the movable portion 13 of the gas discharging member 8 as well as to urge the portion 13 upwardly with a relatively small force so that the portion 13 normally abuts the flanges 12 at the two axial ends of the roll 7. The flanges 12 may but need not rotate with the roll 7; in fact, the roll 7 need not rotate about its horizontal axis. The minimum width of the passage 19 is selected in such a way that, at a given pressure of gas which issues from the orifice 14, the gaseous fluid is capable of optimally cleaning and demoisturizing the web 1 in the passage 19 while the upper portion 13 of the member 8 abuts the flanges 12. At the same time, the springs 10 enable the upper portion 13 to yield (by moving downwardly in order to increase the width of the passage 19) so that a splice between overlapping end portions of two successive webs 1 can readily pass between the roll 7 and the member 8. The same holds true for customary clamps which are used in developing machines to drag the leader of the foremost web 1 of a series of spliced-together webs through various baths and thereupon into the drier of a developing machine. Reference may be had to aforementioned commonly owned U.S. Pat. No. 4,773,580.

The extent to which the flanges 12 project radially beyond the web-contacting peripheral surface of the roll 7 at least matches the thickness of a web 1 but can be less than the combined thickness of two webs. The aforediscussed configuration of the passage 19 (which narrows gradually in the direction of arrow A toward the orifice 14 and thereupon widens gradually in the direction of arrow B) is desirable and advantageous because this ensures predictable introduction of aforediscussed splices and/or clamps into the passage 19 and the advancement of such parts through and beyond the passage. A splice or a clamp simply pushes the upper portion 13 of the member 8 downwardly whereby the width of the passage 19 increases to be immediately reduced by the springs 10 as soon as the splice and/or the clamp has advanced beyond the orifice 14. Thus, the width of the passage 19 is automatically maintained at an optimum value (the upper portion 13 of the member 8 then abuts the flanges 12) in normal operation of the improved apparatus.

The lower portion 15 of the member 8 has an external shoulder defined by a base 20 and serving as a stop for the upper portion 13. The latter can be provided with a handle (not shown) which is actuated by hand or otherwise to move the portion 13 to a lower end position in which the width of the passage 19 is increased to a value which permits convenient threading of the leader of a web 1 or of a band which draws the web 1 through various baths of the developing machine. As a rule, the upper portion 13 of the member 8 will be moved against the stop of the base 20 by a suitable mechanism which becomes operative or which is actuated prior to threading of the leader of a web or a band through the passage 19. The stop of the base 20 can surround a part of or the entire lower portion 15.

When the width of the passage 19 is reduced to a minimum value (because the upper portion 13 of the member 8 abuts the flanges 12), the cleaning and demoisturizing operation of the improved apparatus is based on Bernoulli's hydrodynamic paradox according to which a subatmospheric pressure develops between the member 8 and the running web 1 in the passage 19. The development of subatmospheric pressure in the passage 19 entails that the member 8 is attracted toward the roll 7, but such attracting force is opposed by the force which is generated by the jet or jets of compressed gas issuing from the orifice 14. The force of outflowing compressed gas is balanced by the attracting force which develops as a result of the establishment of subatmospheric pressure in the passage 19.

It is desirable and advantageous to avoid stray movements (such as fluttering) of the web 1 during advancement past the nozzle 14. This is the reason that the web 1 is trained over the peripheral surface of the roll 7 along an arc well in excess of 90°, preferably at least close to 180°. An additional advantage of the apparatus which is shown in FIGS. 2 and 3 (wherein the web 1 is trained over the roll 7 along an arc of close to or exactly 180°) is that the fine mist of atomozed liquid which develops as a result of impingement of compressed gas upon the moisture-carrying underside of the running web 1 is not redeposited on but bypasses the running web downstream of the nozzle 14.

The apparatus can be modified by making the member 8 stationary and by mounting the web guiding member (roll 7) for movement toward and away from the member 8. Furthermore, it is possible to employ a member 7 which is movable toward and away from the member 8 which latter is movable (either in its entirety or in part) toward and away from the member 7. The illustrated embodiment is preferred at this time because it ensures that the web 1 can be conveyed along its path by a simple and reliable conveyor system (the illustrated conveyor system includes the roll 2 in the bath 3 and the pulleys 5 at least one of which is driven in a manner not forming part of the invention if the web 1 is not drawn by a belt or the like).

The springs 10 can be used jointly with or replaced by other biasing means (e.g., by pneumatic cylinder and piston units) which are designed to urge a portion of or the entire member 8 toward and normally against the flanges 12 with the aforediscussed force which at least matches the weight of the member 8 of FIG. 1 or the weight of the movable portion 13 of the member 8 of FIGS. 2 and 3.

In the apparatus of FIG. 1, the discharge end of the flexible conduit (not shown) which serves to connect the member 8 with a source of compressed gas is movable up and down with the member 8 when the latter is displaced under the action or against the opposition of the springs 10. The apparatus of FIGS. 2 and 3 is preferred at this time because the magnitude of the force with which the springs 10 urge the movable upper portion 13 of the member 8 against the flanges 12 is more predictable than in the apparatus of FIG. 1. The reason is that the part (lower portion 15) which is connected with the conduit 16 need not move up and down, i.e., the resistance which the portion 13 offers to upward movement under the bias of the springs 10 is the same at all times.

The minimum width of the passage 19 (when the upper portion 13 of the member 8 abuts the flanges 12) is selected in such a way that the jet or jets of gaseous fluid issuing from the orifice 14 not only displace but actually atomize (disperse) the liquid film at the underside of the running web 1. At the same time, the flanges 12 prevent the establishment of physical contact between the running web 1 and the upper portion 13 of the member 8.

The fact that the development of suction in the passage 19 is interrupted during passage of a splice and/or clamp is of no consequence. The springs 10 ensure that the movable upper portion 13 returns into abutment with the flanges 12 so that the aforediscussed optimal circumstances for removal of moisture from the running web 1 are reestablished in a fully automatic way.

The aforementioned mechanism which serves to move the portion 13 of the member 8' to its lower end position of engagement with the shoulder of the base 20 of the lower member 15 is preferably actuated in automatic response to starting of the developing machine to thus permit convenient threading of the leader of a web 1 or of an entraining band through the enlarged or widened passage 19 in a time-saving manner. The springs 10 then store energy and automatically return the upper portion 13 into engagement with the flanges 12 as soon as the mechanism is deactivated.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for removing entrained substances from running webs with a gaseous fluid, particularly, for removing moisture from running webs of exposed and developed photographic paper, comprising a web guiding member; a fluid discharging member adjacent said guiding member and defining therewith a web-receiving passage of variable width; and self-adjusting means for supporting at least one of said members for movement relative to the other of said members in directions to vary the width of said passage while a web is running therethrough.

2. The apparatus of claim 1, wherein said web guiding member comprises a roll and the web is trained over said roll along an arc of more than 90°, said passage being adjacent that portion of the web which is trained over said roll.

3. The apparatus of claim 2, wherein said roll is rotatable about a fixed axis and said fluid discharging member is movable relative to said roll.

4. The apparatus of claim 2, further comprising means for conveying the web toward and away from said roll along a predetermined path having a first portion wherein successive increments of the web advance toward said roll in a first direction and a second portion wherein successive increments of the web advance away from said roll in a second direction, said fluid discharging member being movable relative to said roll in at least one of said directions.

5. The apparatus of claim 2, wherein said roll is located at a level above said fluid discharging member, said supporting means including means for biasing said fluid discharging member upwardly toward said roll with a force which compensates for or slightly exceeds the weight of said fluid discharging member.

6. The apparatus of claim 5, further comprising means for limiting the extent of movability of said fluid discharging member toward said roll.

7. The apparatus of claim 6, wherein said limiting means is provided on said roll.

8. The apparatus of claim 5, wherein said fluid discharging member is movable against the opposition of said biasing means to a lower end position in which the width of said passage suffices for convenient threading of the web through said passage.

9. The apparatus of claim 1, wherein said web guiding member is located at a level above said fluid discharging member and said fluid discharging member includes a lower portion and an upper portion which is movable relative to said lower portion toward and away from said web guiding member to thereby vary the width of said passage, said upper portion having at least one orifice which directs fluid against the web in said passage.

10. The apparatus of claim 9, wherein the fluid is compressed air and said at least one orifice is an elongated slot in said upper portion.

11. The apparatus of claim 1, further comprising means for conveying the web into said passage in a predetermined direction and said fluid discharging member has at least one fluid discharging orifice at said passage, said passage having a width which decreases in said direction toward said at least one orifice.

12. The apparatus of claim 1, wherein one of said members is located at a level above the other of said members.

13. The apparatus of claim 1, further comprising means for limiting the extent of movability of said at least one member toward the other of said members so as to prevent physical contact between the web in said passage and said fluid discharging member.

14. Apparatus for removing entrained substances from running webs with a gaseous fluid, particularly for removing moisture from running webs of exposed and developed photographic paper, comprising a web guiding member including a roll, the web being trained over said roll along an arc of more than 90°; a fluid discharging member adjacent said roll and defining therewith a web-receiving passage of variable width, said passage being adjacent that portion of the web which is trained over said roll and said roll being located at a level above said fluid discharging member; and means for supporting at least one of said members for movement relative to the other of said members in directions to vary the width of said passage, said supporting means including means for biasing said fluid discharging member upwardly toward said roll with a force which compensates for or slightly exceeds the weight of said fluid discharging member.

15. The apparatus of claim 14, further comprising means for limiting the extent of movability of said fluid discharging member toward said roll.

16. The apparatus of claim 15, wherein said limiting means is provided on said roll.

17. The apparatus of claim 14, wherein said fluid discharging member is movable against the opposition of said biasing means to a lower end position in which the width of said passage suffices for convenient threading of the web through said passage.

* * * * *

UNITED STATES PATENT AND TRADEMARK OFFICE

CERTIFICATE OF CORRECTION

PATENT NO. : 5,205,053

DATED : April 27, 1993

INVENTOR(S) : Jürgen BRUNNER et al.

It is certified that error appears in the above-identified patent and that said Letters Patent is hereby corrected as shown below:

ON THE TITLE PAGE:

[75] Inventor: --Ernst SCHWEIGER, Munich, Federal Republic Germany-- was omitted and should be added.

Signed and Sealed this

Fifteenth Day of March, 1994

Bruce Lehman

*Attest:*

BRUCE LEHMAN

*Attesting Officer*

*Commissioner of Patents and Trademarks*